United States Patent [19]

Hasegawa

[11] 3,942,675

[45] Mar. 9, 1976

[54] FULL OPENING RECLOSABLE CONTAINER CLOSURE

[75] Inventor: Gary Hasegawa, Morton Grove, Ill.

[73] Assignee: Continental Can Company, Inc., New York, N.Y.

[22] Filed: July 29, 1974

[21] Appl. No.: 492,743

[52] U.S. Cl. ..... 220/260; 215/278; 220/266; 220/279

[51] Int. Cl.[2] ..... B65D 41/02

[58] Field of Search ..... 220/266, 267, 279, 320, 220/268, 269, 265, 260, 276; 215/253, 272, 250, 278, 252, 258, 295, 301, 303, 304, 305

[56] References Cited

UNITED STATES PATENTS

| | | | |
|---|---|---|---|
| 2,372,725 | 4/1945 | Koehler | 215/272 |
| 2,940,628 | 6/1960 | Schultz | 215/272 |
| 3,499,574 | 3/1970 | Yates, Jr. | 220/320 X |
| 3,650,428 | 3/1972 | Miller | 215/252 |

FOREIGN PATENTS OR APPLICATIONS

| | | | |
|---|---|---|---|
| 154,420 | 12/1950 | Sweden | 215/252 |

*Primary Examiner*—William Price
*Assistant Examiner*—Stephen P. Garbe
*Attorney, Agent, or Firm*—Diller, Brown, Ramik & Wight

[57] ABSTRACT

A container closure of the type having a friction fit on a container and including a depending skirt radially inwardly deformed below a radially outward projection on the container body is provided with a peripheral weakening line generally at the point where the skirt of the closure tends to bend below the body projection and wherein tensioning means are carried by the lower skirt portion for radially inwardly tensioning the skirt portion below the line of weakening so that by utilizing the tensioning means, the lower skirt portion may be detached from the remainder of the closure and the closure being free to be removed from and replaced on the container. The tensioning means is also utilized to tightly clamp the removed skirt portion to the exterior of the container so that the removed skirt portion is not discarded separately from the container.

10 Claims, 4 Drawing Figures

FULL OPENING RECLOSABLE CONTAINER CLOSURE

This invention relates in general to new and useful improvements in containers and more particularly to an easy opening container.

In the recent past numerous easy opening containers of varying constructions and configurations have been delevoped. However, these containers are primarily of the type wherein a portion of the end panel of the closure is removed to facilitate dispensing of the product and, in certain instances, wherein the product is liquid, the rupturable panel portion may be pressed inwardly of the container so as to remain a part thereof. However, little progress has been made in the field of container closures of the friction fit type wherein the container closure, when once removed, may be readily re-applied for the purpose of resealing the container.

In accordance with this invention, it is proposed to provide a friction type closure for a container wherein the closure is provided with a depending skirt which is radially inwardly deformed beneath an external projection on the container body. In lieu of requiring a special opener to deform or spring the skirt outwardly so as to effect the removal of the closure, in accordance with this invention, the depending skirt portion is removed in its entirety so that the closure is free to be removed and replaced.

The removal of the closure retaining skirt portion is facilitated by providing the same with a peripheral line of weakening and applying to the depending skirt portion a tensioning device for radially inwardly tensioning the depending skirt portion so as to effect rupture thereof along the line of weakening.

In accordance with this invention, the means for tensioning the lower skirt portion is merely in the form of a wire hoop having a projecting loop portion which can be twisted so as to tighten the wire hoop about the skirt portion. As the skirt portion is radially inwardly deformed, it is tensioned at the line of weakening and thus rupture occurs.

A further feature of the invention is the forming of the container body with an annular groove for receiving that part of the removable skirt portion which is radially inwardly deformed in interlocking relation so as to retain the removable skirt portion on the container body after it has been broken from the remainder of the closure so that no portion of the closure is discarded separately of the remainder of the container.

With the above and other objects in view that will hereinafter appear, the nature of the invention will be more clearly understood by reference to the following detailed description, the appended claims and the several views illustrated in the accompanying drawings.

Figure 1:
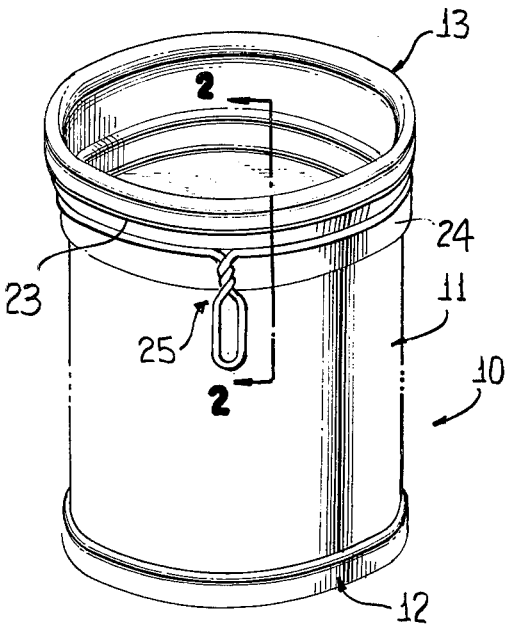
FIG. 1 is a top perspective view of a container provided with the easy opening closure.

Referring now to the drawings, it will be seen that there is illustrated a container formed in accordance with this invention, the container generally being identified by the numeral 10. The container 10 includes a container body 11 having the lower end thereof closed by an end closure 12. The upper end of the container body 11 is normally open and is closed by a further end closure 13 which has a friction fit with the container body 11 and which has easy opening means facilitating the releasing thereof from the container body 11.

The container body 11 is provided at the upper end thereof with a hollow radially outwardly directed projection 14. Below the projection 14, the container body 11 is provided with an inwardly directed peripheral recess 15.

The closure 13 is preferably formed of metal, such as aluminum, although it may be formed of other suitable materials, including, in certain instances, plastic. The closure 13 is provided with an end panel 16 which is connnected to an inner cylindrical wall 17 by an inwardly offset cylindrical wall portion 18. The closure 13 also includes a depending skirt 20 which is connected to the cylindrical wall 17 by means of a reverse bend or curl 21.

The interior surface of the bend 21 is coated with a suitable sealing compound 22. Thus, when the closure 13 is applied to the container body 11 by a downward force, a seal is effected between the closure 13 and the container body 11, the sealing compound 22 pressing against the hollow projection 14 and being in sealing contact therewith.

It is to be understood that the dimensional relationship between the closure 13 and the upper portion of the container body 11 is one wherein there is a frictional fit so that the closure 13 is normally retained in place on the container body. However, for shipping and handling purposes, in order to firmly retain the closure 13 on the container body 11, the skirt 20 would normally be radially inwardly deformed below the projection 14 in any conventional manner.

In accordance with this invention, the skirt 20 is relatively elongated and is modified by being provided with a peripheral weakening line in the form of a score 23 at the point where the skirt 10 is to bend and be stressed relative to the projection 14 when the lower portion of the skirt is radially inwardly deformed.

The portion of the skirt 20 below the weakening line 30 will hereinafter be defined as the lower skirt portion and identified by the numeral 24.

The lower skirt portion 24 is provided with a tensioning device generally identified by the numeral 25. The tensioning device 25 is simply in the form of a wire hoop which passes around a middle part of the lower skirt portion 24 and then is twisted as at 26 leaving an eye 27. It is to be noted that that portion of the hoop of wire which directly encircles the lower skirt portion 24 is seated in an annular recess 28 which, in turn, defines an inwardly projecting rib 30.

The closure 13 is initially retained on the container body 11 by the lower skirt portion 24 being radially inwardly deformed below the projection 14. The lower skirt portion 24 is retained in this position by the tensioning device 25. It is to be noted at this time that the twisted portion 26 and the eye 27 of the wire hoop are in a depending relation alongside the container body 11 during normal shipping and storage.

Figure 3:
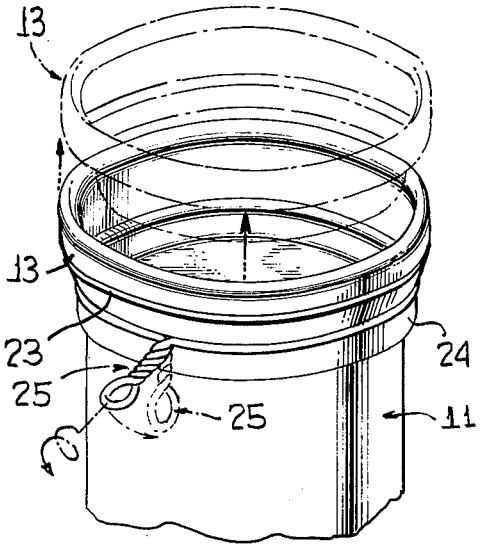
FIG. 3 is a fragmentary schematic perspective view of the container of FIG. 1 and shows the manner in which the container is opened.
Figure 2:
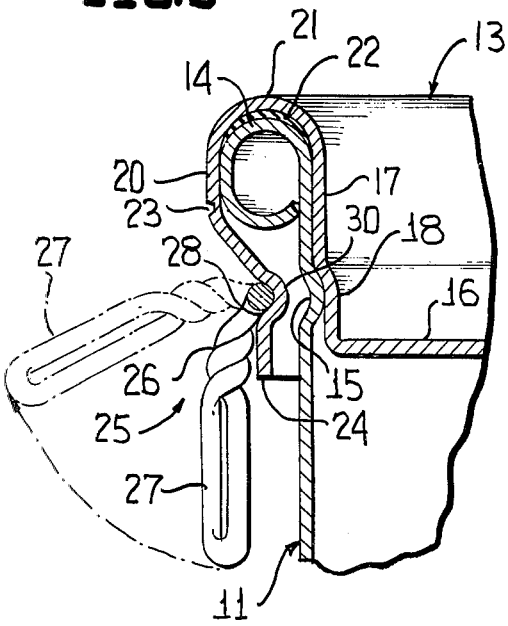
FIG. 2 is an enlarged fragmentary sectional view taken along line 2—2 of FIG. 1 and shows the details of the easy opening feature of the closure.
Figure 4:
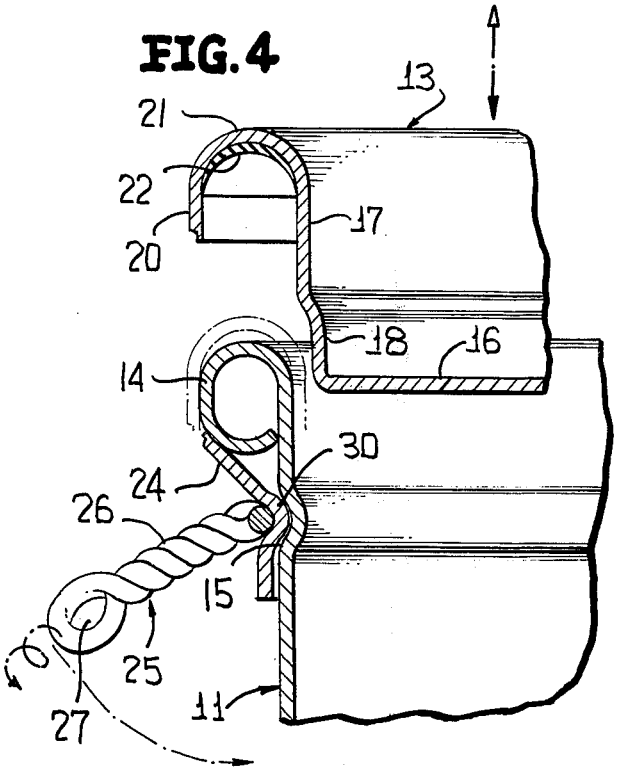
FIG. 4 is an enlarged fragmentary vertical sectional view similar to FIG. 2 and shows the closure released from the container.

When it is desired to open the container 10, the eye 27 is lifted to the dotted line position shown in FIG. 2 and thereafter twisted in a counterclockwise direction, as schematically shown in FIGS. 3 and 4 to further twist the wire hoop and to tighten the same around the lower skirt portion 24. The twisting of the wire hoop may be accomplished by means of any suitable implement, for example the handle of a spoon, if necessary.

As is shown in FIG. 4, the radial inward deformation of the lower skirt portion 24 to a point where it approaches the container body 11 will result in applying a combined bending and tensile force on the skirt 20 along the line of weakening defined by the score 23 so as to effect separation of the lower skirt portion 24 from the remainder of the skirt 20. The remainder of the closure 13 is now free to be lifted from the container in the manner shown generally in FIGS. 3 and 4.

It is to be noted that at the time rupture of the lower skirt portion 24 from the skirt 20 occurs, the bead 30 is substantially seated in the annular recess 15 of the container body 11 so that a slight further twisting of the wire hoop will result in the interlocking of the bead 30 and the retention of the removed lower skirt portion 24 with the container.

It is to be understood that once the closure 13 has been removed from the container, if it is desired to reseal the container, this may be accomplished by merely pressing the closure 13 back into place on the container body 11. It is to be understood that the frictional relationship between the closure 13 and the container body 11 will be retained and a good seal will be effected. It is also pointed out here that the twisted portion of the wire hoop may be depressed to the dotted line position shown in FIG. 3 and as schematically indicated in FIG. 4 after the opening process has been completed.

It is to be understood that the constructional details of the container 11, except for the necessity of the projection 14 and the desirability of providing the annular recess 15, may be varied in any manner desired without departing from the principles of this invention.

Although only a preferred embodiment of the invention has been specifically illustrated and described herein, it is to be understood that minor variations may be made in the container construction without departing from the spirit and scope of the invention, as defined by the appended claims.

What is claimed as new:

1. An easy opening container closure of the type having a depending external retaining skirt, a peripheral weakening line around said skirt, and tensioning means carried by said skirt below said weakening line for tensioning said skirt along said weakening line and effecting rupture of said skirt along said weakening line.

2. The container closure of claim 1 wherein said closure is of the type wherein said skirt has a radially inwardly directed deformation formed independently of said tensioning means to retain said closure on a container, and said tensioning means also functions as retaining means.

3. The container closure of claim 1 wherein said tensioning means is a device extending about said skirt and includes means for foreshortening the same to apply a radial inwardly pressure on said skirt.

4. The container closure of claim 3 wherein said device is in the form of a wire hoop.

5. The container closure of claim 3 wherein said skirt has an annular groove receiving said device.

6. The container closure of claim 1 wherein said closure is carried by a container body having an outer peripheral projection at one end thereof, said closure is mounted on said container body one end, said skirt is deformed radially inwardly below said peripheral projection, and said tensioning means are disposed below said peripheral projection.

7. The container closure of claim 6 wherein said skirt has a natural bend line adjacent said peripheral projection, and said weakening line is disposed along said bend line.

8. The container closure of claim 6 wherein said tensioning means is a device extending about said skirt and includes means for foreshortening the same to radially inwardly deform said skirt and thereby effect stressing of said skirt along said weakening line.

9. The container closure of claim 8 wherein said device is in the form of a wire hoop.

10. The container closure of claim 6 wherein said skirt has an annular groove receiving said device, and said container body has a radially inwardly directed annular groove aligned with said skirt annular groove and receiving the same subsequent to rupture of said skirt along said weakening line to retain a released lower portion of said skirt attached to said container body.

* * * * *